United States Patent [19]

Stoltman et al.

[11] 4,359,031

[45] Nov. 16, 1982

[54] ENGINE AIR FLOW RESPONSIVE CONTROL

[75] Inventors: Donald D. Stoltman, Henrietta; William E. Gifford, Spencerport, both of N.Y.

[73] Assignee: General Motors Corporation, Detroit, Mich.

[21] Appl. No.: 18,130

[22] Filed: Mar. 7, 1979

[51] Int. Cl.[3] ..... F02M 39/00; F02M 69/04

[52] U.S. Cl. ..... 123/452; 123/453; 261/69 A

[58] Field of Search ..... 123/452, 453, 454, 455, 123/456, 463; 261/51, 69 A, 67, DIG. 38; 137/625.17, 625.3; 251/205

[56] References Cited

U.S. PATENT DOCUMENTS

| | | | |
|---|---|---|---|
| 2,390,658 | 12/1945 | Mock | 261/69 |
| 2,426,153 | 8/1947 | Mock | 123/452 |
| 3,730,155 | 5/1973 | Knapp | 123/452 |
| 3,791,359 | 2/1974 | Eckert | 123/452 |

FOREIGN PATENT DOCUMENTS

| | | | |
|---|---|---|---|
| 471508 | 9/1937 | United Kingdom . | |
| 474975 | 11/1937 | United Kingdom | 123/454 |

*Primary Examiner*—Charles J. Myhre
*Assistant Examiner*—Carl Stuart Miller
*Attorney, Agent, or Firm*—C. K. Veenstra

[57] ABSTRACT

An engine charge forming device controls the fuel metering orifice area in proportion to the throttled air flow area of the induction passage and controls the pressure drop across the fuel metering orifice in proportion to a vacuum signal which is substantially independent of the compressibility effects of throttled air flow; fuel flow is thereby proportioned to air flow throughout the range of engine operating conditions. Adjustments are provided for varying the fuel metering orifice area to set minimum and maximum fuel flows, and controls are provided for modifying the vacuum signal to vary air-fuel ratio.

9 Claims, 16 Drawing Figures

ENGINE AIR FLOW RESPONSIVE CONTROL

RELATED APPLICATION

The embodiment of this invention depicted herein also includes the charge forming apparatus of U.S. patent application 18,434 filed Mar. 7, 1979 now U.S. Pat. No. 4,286,562 in the name of D. D. Stoltman.

TECHNICAL FIELD

This invention relates to engine air flow responsive control.

BACKGROUND

Engine air flow responsive controls are useful in a variety of engine control applications such as, for example, control of fuel metering, ignition timing and exhaust gas recirculation. It has long been desired to measure engine air flow with readily available signals such as the combination of manifold vacuum and throttle position. However, manifold vacuum is not an adequate indication of engine air flow, particularly during engine operating conditions when it exceeds one-half the inlet air pressure and the rate of air flow past the throttle becomes sonic, due to the compressible nature of air flow. Accordingly, prior engine air flow responsive controls have required items such as engine speed sensors, air valves with position sensors, or other engine air flow sensors.

SUMMARY OF THE INVENTION

This invention provides apparatus for and a method of engine air flow responsive control in which a vacuum signal is created that is substantially independent of the compressibility effects of throttled air flow and in which that signal is employed together with throttle position as a measure of engine air flow.

We have found that a vacuum signal, created in a portion of an induction passage which bypasses or parallels the throttle bore portion of the induction passage, varies substantially uniformly with engine air flow through the induction passage both when the manifold vacuum is less than one-half the inlet pressure and when the manifold vacuum is greater than one-half the inlet pressure. The vacuum signal is thus substantially independent of the compressibility effects of the air flow and provides an excellent indication of engine air flow for any selected throttle position.

Based on that finding, we have developed an engine air flow responsive control which employs that vacuum signal together with throttle position as a measure of engine air flow. In the embodiments of this invention depicted herein, an engine air flow responsive charge forming apparatus controls a fuel metering orifice area in accordance with throttle position and controls the pressure drop across the metering orifice in proportion to the vacuum signal; fuel flow is thereby proportioned to engine air flow throughout the range of engine operating conditions.

The details as well as other features and advantages of this invention are set forth in the remainder of the specification and are shown in the accompanying drawings.

BEST MODE FOR CARRYING OUT THE INVENTION

Figure 1:
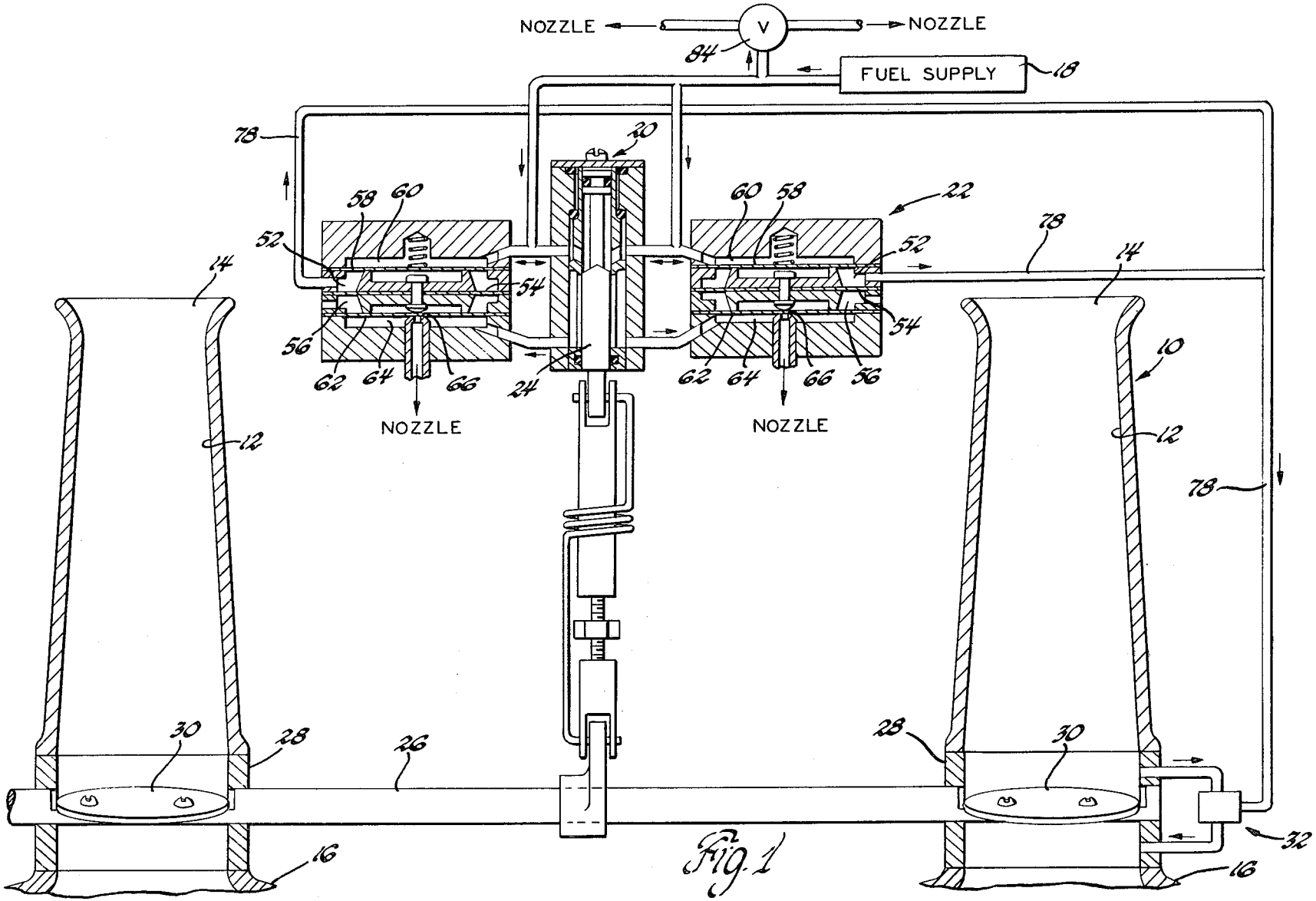
FIG. 1 is a schematic illustration of an engine air flow responsive charge forming apparatus employing this invention.

Referring first to FIG. 1, an engine charge forming apparatus 10 includes a pair of air induction passages 12 opening from an air inlet region 14 to an intake manifold 16. Fuel is delivered from a fuel supply 18 through a fuel meter 20 and a dual element pressure regulator 22 to fuel nozzles (not shown).

Fuel meter 20 includes a metering rod 24 connected to and operated by a throttle shaft 26. Throttle shaft 26 is mounted in a throttle body 28 and positions a pair of throttles 30 for controlling air flow through induction passages 12. Throttle body 28 includes a transducer 32 which creates a pressure signal indicative of the air flow through induction passages 12.

Throttle body 28 may have a variety of forms. As shown schematically in FIG. 2*a*, a throttle body 28*a* includes a throttle bore portion 34*a* of an induction passage 12 and its transducer 32*a* includes a bypass portion 36*a* of induction passage 12. Bypass portion 36*a* includes a pair of orifices 38*a* and 40*a* defining a signal region 42*a*. Orifices 38*a* and 40*a* create a reduced pressure signal in region 42*a* that differs from the pressure in air inlet region 14 by an amount—herein termed a vacuum signal—which is substantially proportional to the square of the rate of air flow through induction passage 12.

Figure 3:
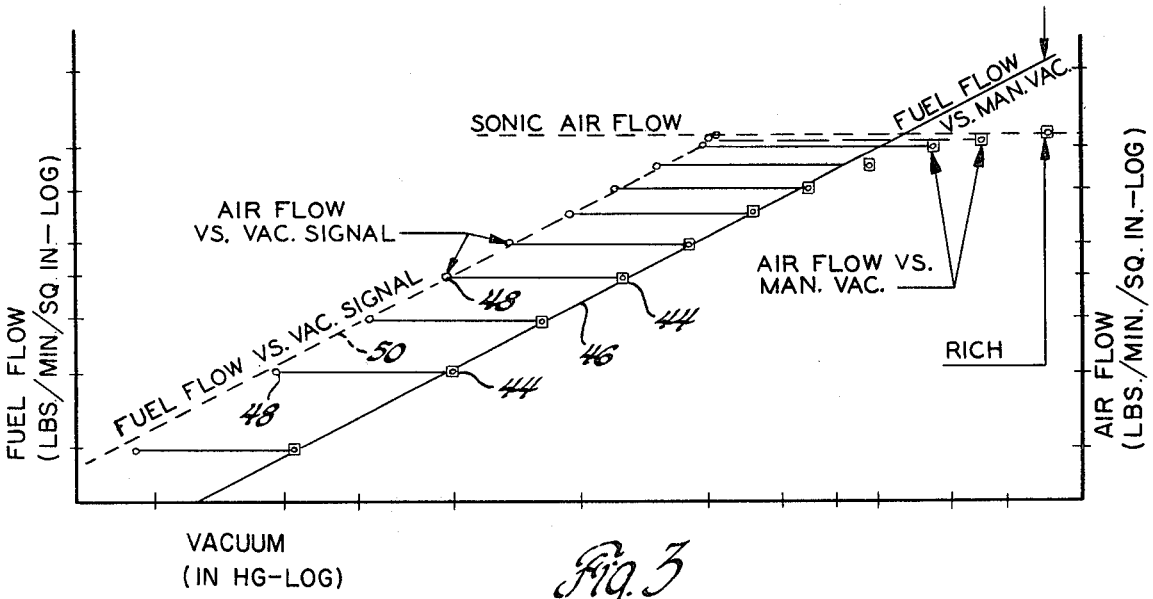
FIG. 3 is a log-log plot comparing apparatus employing this invention with prior apparatus.
Figure 4:
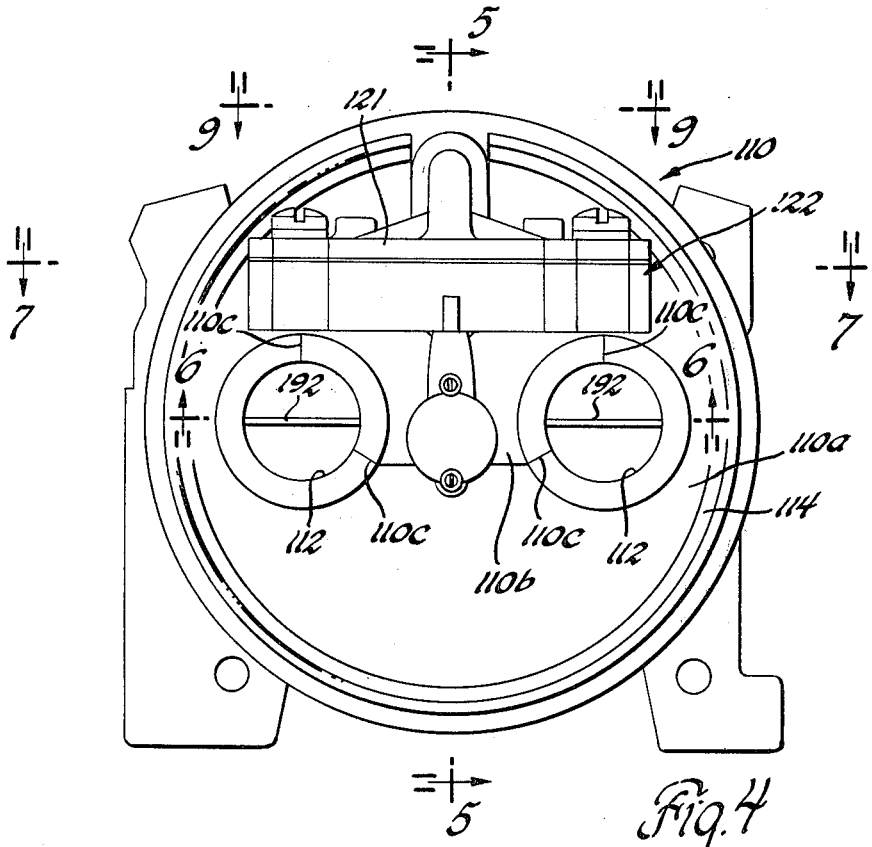
FIG. 4 is a plan view of a two barrel pressure carburetor employing this invention.

It should be appreciated that for any selected position of throttles 30, the rate of air flow through induction passages 12 initially increases substantially in proportion to the square root of the pressure drop across throttles 30—that is, the difference between the pressure in air inlet region 14 and the pressure in manifold 16, usually called manifold vacuum. However, when the manifold pressure becomes less than about one-half the inlet pressure, the rate of air flow past throttles 30 becomes sonic. The small squares 44 in FIG. 3 illustrate the relationship between manifold vacuum (on the horizontal axis) and air flow (on the vertical axis) for any selected position of throttles 30. They show that air flow increases with manifold vacuum until manifold vacuum rises above about one-half the inlet region pressure; thereafter, air flow does not increase substantially with manifold vacuum due to the compressible nature of air flow. Thus manifold vacuum is not an adequate indication of engine air flow, particularly when it exceeds one-half the inlet region pressure. For example, if fuel flow were metered according to manifold vacuum in an attempt to provide fuel flow in proportion to air flow, fuel flow would follow the solid line 46 of FIG. 3 and would exceed the desired proportion, providing a richer mixture as indicated in the upper right corner of FIG. 3, when manifold vacuum exceeded one-half the inlet region pressure.

The small circles 48 in FIG. 3 illustrate the relationship between the vacuum signal of region 42*a* (on the horizontal axis) and air flow (on the vertical axis) through induction passages 12 for any selected position of throttles 30. They show that the vacuum signal of region 42*a* varies substantially uniformly with the square of air flow through induction passages 12, even when manifold vacuum exceeds one-half the inlet region pressure and air flow past throttles 30 has become sonic. Accordingly, the vacuum signal is independent of the compressible nature of the air flow and provides an excellent indication of engine air flow for any selected position of throttles 30, both when manifold vacuum is less than one-half the inlet region pressure and when manifold vacuum is greater than one-half the inlet region pressure. Fuel flow metered according to the vacuum signal follows the broken line 50 of FIG. 3 and provides fuel flow substantially proportional to air flow throughout the range of engine operation.

It will be appreciated, of course, that the vacuum signal of region 42*a* is actually determined only by air flow through the bypass portion 36*a* of induction passage 12. As throttle 30 is opened, the effective area of induction passage 12 increases and a smaller proportion of the total engine air flow passes through bypass portion 36*a*. Thus both the effective area of induction passage 12 and the vacuum signal must be monitored to measure the rate of air flow through induction passage 12.

To provide fuel flow proportional to air flow, the position of throttles 30 is selected as indicative of the effective air flow area of induction passages 12, and metering rod 24 is positioned by throttles 30 to establish a fuel metering area in fuel meter 20 substantially proportional to the effective air flow area. The pressure signal in region 42*a* is applied to a signal chamber 52 in pressure regulator 22. A diaphragm 54 separates chamber 52 from a chamber 56 open to the pressure of air inlet region 14. Diaphragm 54 accordingly creates a force proportional to the difference between the inlet region pressure and the pressure signal in region 42*a*—that is, proportional to the vacuum signal of region 42*a*. A diaphragm 58 separates signal chamber 52 from a chamber 60 which senses the pressure of the fuel supplied to fuel meter 20. A diaphragm 62 separates chamber 56 from a chamber 64 which senses the pressure of the fuel discharged by fuel meter 20. The force on diaphragm 54 due to the vacuum signal of region 42*a* is accordingly offset by the force on diaphragms 58 and 62 due to the pressure drop across fuel meter 20, and diaphragm 62 controls flow from chamber 64 through a valve seat 66 to maintain the pressure drop across fuel meter 20 substantially proportional to the vacuum signal of region 42*a*.

Thus with the fuel metering area proportional to the effective flow area of induction passages 12 and the pressure drop across the fuel metering area proportional to the signal provided by transducer 32, fuel flow to the fuel nozzles will be proportional to air flow through induction passages 12.

It will be appreciated that air flow through both throttle bore portion 34*a* and bypass portion 36*a* of induction passage 12 will vary with the pressure in air inlet region 14 and will increase should region 14 be charged with a pressure above atmospheric. That effect is appropriately balanced in charge forming apparatus 10 by having chamber 56 sense the pressure—whether atmospheric or non-atmospheric—in inlet region 14.

Figure 2A:
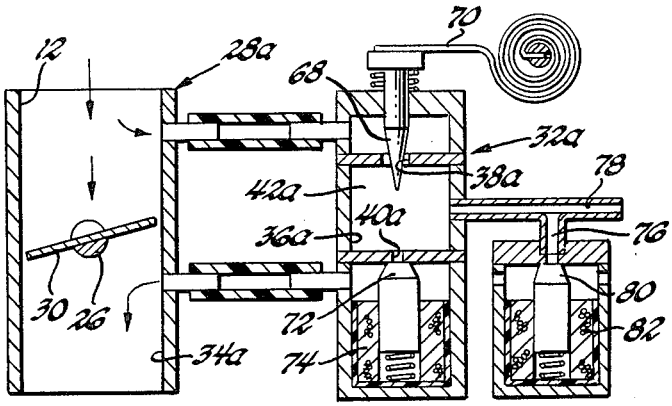
FIG. 2*a* is a schematic view showing details of the embodiment of the engine air flow sensor included in the FIG. 1 apparatus.
Figure 2B:
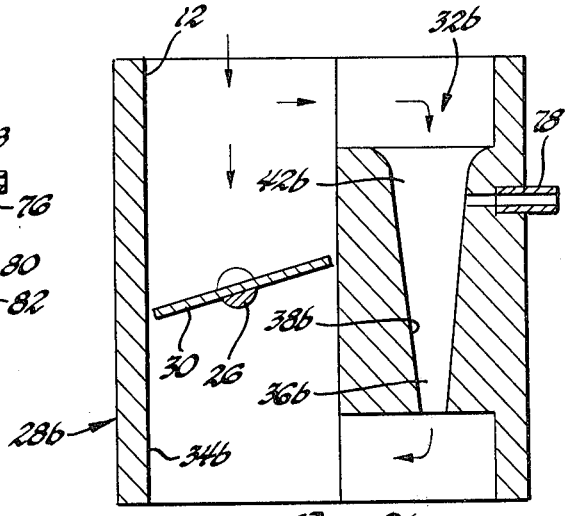
FIGS. 2*b*, 2*c*, 2*d*, 2*e* and 2*f* are schematic views illustrating other embodiments of the engine air flow sensor.

FIGS. 2*b* through 2*f* schematically illustrate other embodiments of the engine air flow sensor in which the transducer is integrated in the throttle body. Referring to FIG. 2*b*, a throttle body 28*b* includes a throttle bore portion 34*b* of an induction passage and its transducer 32*b* includes a bypass portion 36*b* of the induction passage. Within bypass portion 36*b*, a converging nozzle 38*b* defines a signal region 42*b* which creates a vacuum signal that is substantially proportional to the square of the rate of air flow through the induction passage.

Figure 2C:
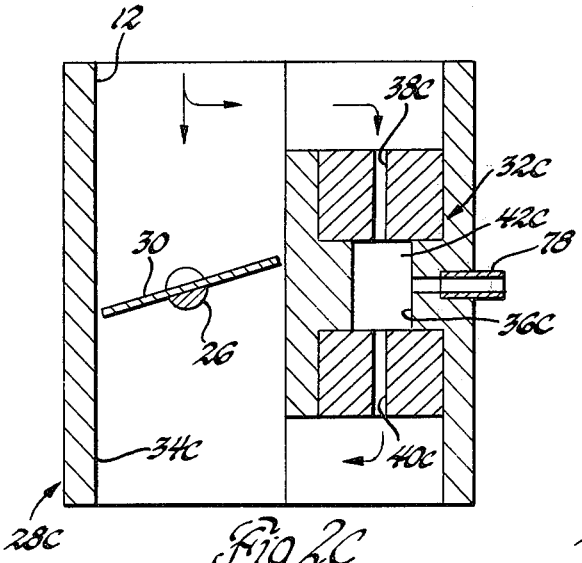

In FIG. 2*c*, a throttle body 28*c* includes a throttle bore portion 34*c* of an induction passage and its transducer 32*c* includes a bypass portion 36*c* of the induction passage. Within bypass portion 36*c*, a pair of capillary tube orifices 38*c* and 40*c* define a signal region 42*c* which creates a vacuum signal that is substantially proportional to the square of the rate of air flow through the induction passage.

Figure 2D:
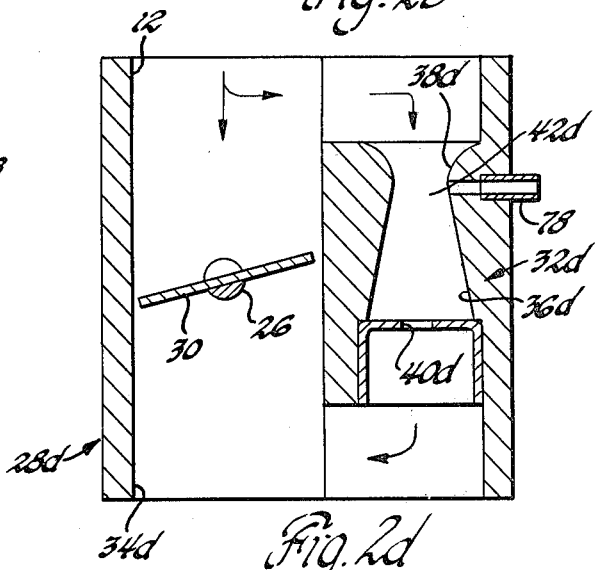

In FIG. 2*d*, a throttle body 28*d* includes a throttle bore portion 34*d* of an induction passage and its transducer 32*d* includes a bypass portion 36*d* of the induction passage. Within bypass portion 36*d*, an orifice 38*d* in the form of a venturi and another orifice 40*d* define a signal region 42*d* which creates a vacuum signal that is substantially proportional to the square of the rate of air flow through the induction passage.

Figure 2E:
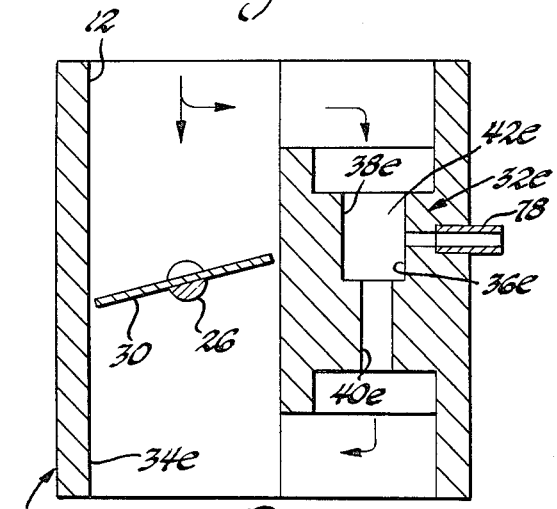

In FIG. 2*e*, a throttle body 28*e* includes a throttle bore portion 34*e* of an induction passage and its transducer 32*e* includes a bypass portion 36*e* of the induction passage. Within bypass portion 36*e*, a pair of stepped orifices 38*e* and 40*e* define a signal region 42*e* which creates a vacuum signal that is substantially proportional to the square of the rate of air flow through the induction passage.

Figure 2F:
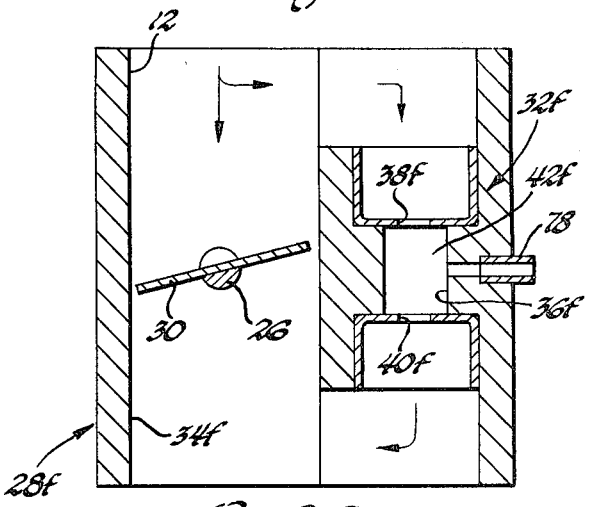

In FIG. 2*f*, a throttle body 28*f* includes a throttle bore portion 34*f* of an induction passage and its transducer 32*f* includes a bypass portion 36*f* of the induction passage. Within bypass portion 36*f*, a pair of orifices 38*f* and 40*f* define a signal region 42*f* which creates a vacuum signal that is substantially proportional to the square of the rate of air flow through the induction passage.

It will be appreciated that each of the embodiments of the air flow sensor shown in FIGS. 2*a* through 2*f* may be employed in the charge forming apparatus of FIG. 1, and when so employed, will provide a measure of the engine air flow for controlling fuel flow in proportion to engine air flow. It will be further appreciated that the various embodiments of the engine air flow sensor may be employed to measure engine air flow in other air flow responsive engine controls. Moreover, it will be appreciated that the various embodiments of the engine air flow sensor may be employed to measure engine air flow in electronic engine control apparatus as well as the mechanical apparatus shown in FIG. 1.

FIG. 2*a* also shows controls which may be employed to vary the vacuum signal during selected engine operating conditions. A valve 68 varies the area of orifice 38*a* and is controlled by an engine temperature responsive coil thermostat 70 to reduce the area of orifice 38*a* as engine temperature decreases; such operation will increase the vacuum signal of region 42*a*. As a result, pressure regulator 22 will increase the pressure drop across fuel meter 20 to provide the increased fuel flow to the fuel nozzles which will enrich the air-fuel mixture as necessary for cold engine operation.

A valve 72 is associated with orifice 40*a* and is operated by a solenoid coil 74 which is energized according to a controlled duty cycle. As the duty cycle of coil 74 is decreased from 100%, valve 72 will obstruct orifice 40*a* an increased proportion of the operating time; such operation will reduce the vacuum signal of region 42*a*. As a result, pressure regulator 22 will reduce the pressure drop across fuel meter 20 to reduce fuel flow to the fuel nozzles. The duty cycle of coil 74 may be varied in response to the measured air-fuel ratio of the charge provided by charge forming apparatus 10 to maintain a stoichiometric air-fuel ratio or any other desired air-fuel ratio.

A separate air bleed 76 opens into the signal passage 78 extending from signal region 42*a* to signal chamber 52. A valve 80 regulates flow through bleed 76 and is operated by a solenoid coil 82. When coil 82 is energized, valve 80 will permit air to flow through bleed 76, thus reducing the vacuum signal delivered to signal chamber 52. As a result, pressure regulator 22 will reduce the pressure drop across fuel meter 20 to reduce fuel flow to the fuel nozzles. Coil 80 may be energized to lean the mixture as desired during deceleration or coasting.

It will be appreciated that valves 68, 72 and 80 may be controlled manually or in response to other engine operating parameters to modify the vacuum signal of region 42*a*, and thus vary the air-fuel ratio of the charge provided by charge forming apparatus 10, in any desired manner.

As shown schematically in FIG. 1, additional fuel for starting may be provided by a valve 84 which is operated to direct fuel from fuel supply 18 to fuel nozzles (not shown).

FIGS. 4 through 10 show a two barrel pressure carburetor 110 employing this invention. Carburetor 110 includes a pair of air induction passages 112 opening from an air inlet region 114 to an intake manifold (not shown). Air induction passages 112 are formed by an outer air horn section 110*a*, an inner fuel body section 110*b* and a lower throttle body section 128. It will be noted that air horn section 110*a* and fuel body section 110*b* meet along joints 110*c* in the walls of air induction passages 112.

A fuel supply passage 118 extends to a fuel meter 120 through the cover 121 of a dual element pressure regulator 122.

Fuel meter 120 includes a metering rod 124 connected by a linkage 125 to the throttle shaft 126. Linkage 125 includes a lever 125*a* secured to shaft 126 and pivotally connected to a lower link 125*b*. Lower link 125*b* is connected by a threaded adjusting screw 125*c* to an upper link 125*d* which is pivotally connected to metering rod 124. Thus as throttle shaft 126 is rotated in throttle body 128 to open the throttles 130, lever 125*a* pulls the links downwardly to lower metering rod 124 and increase the fuel metering area in fuel meter 120.

Figure 5:
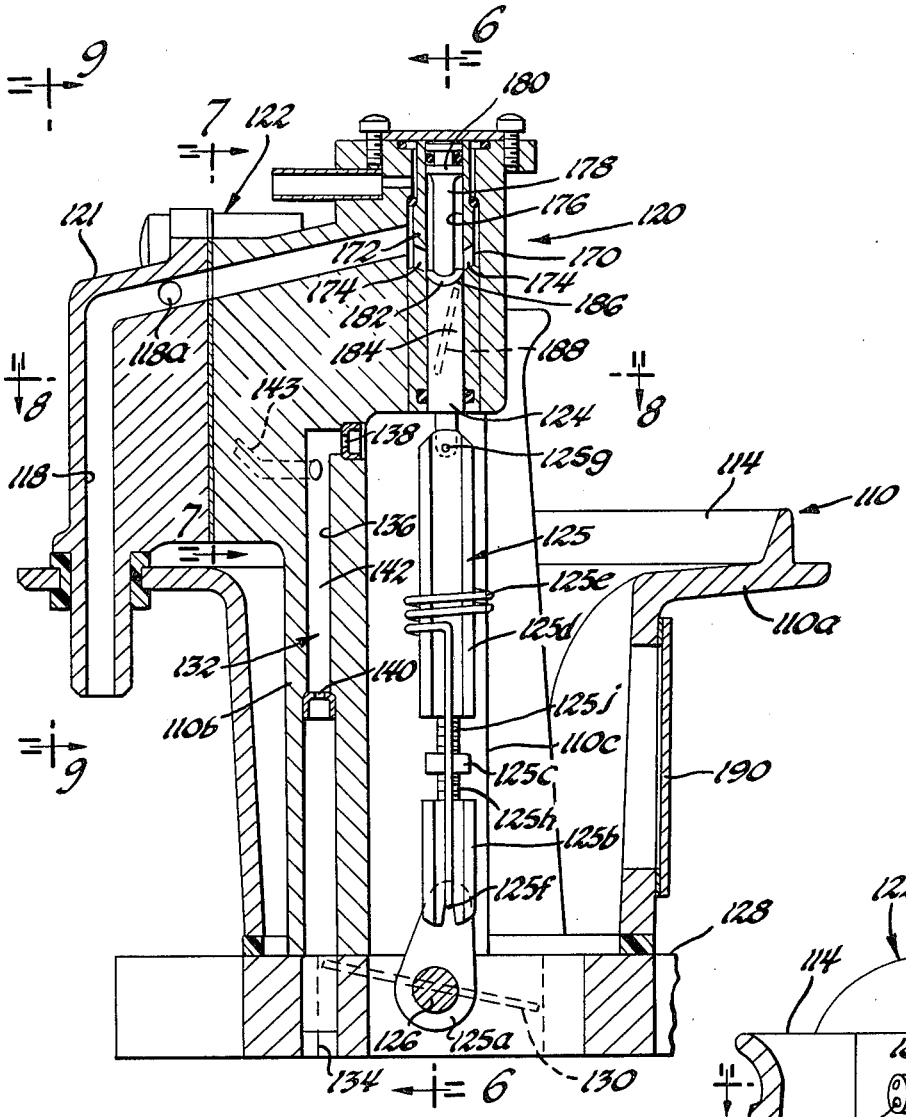
FIG. 5 is an axial sectional view of that carburetor, as indicated by the lines 5—5 of FIGS. 4, 6, 7 and 8, showing its air flow sensor, fuel supply passage and fuel meter.
Figure 7:
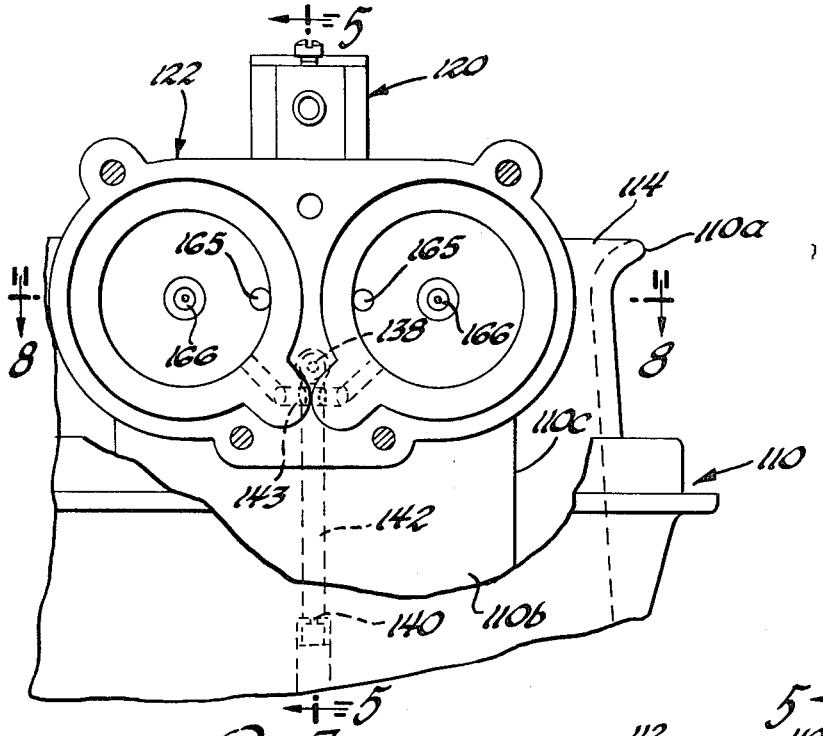
FIG. 7 is an end view of that carburetor, with its pressure regulator cover and diaphragms removed as indicated by the lines 7—7 of FIGS. 4, 5 and 8, showing a portion of its fuel and air flow sensor passages.
Figure 8:
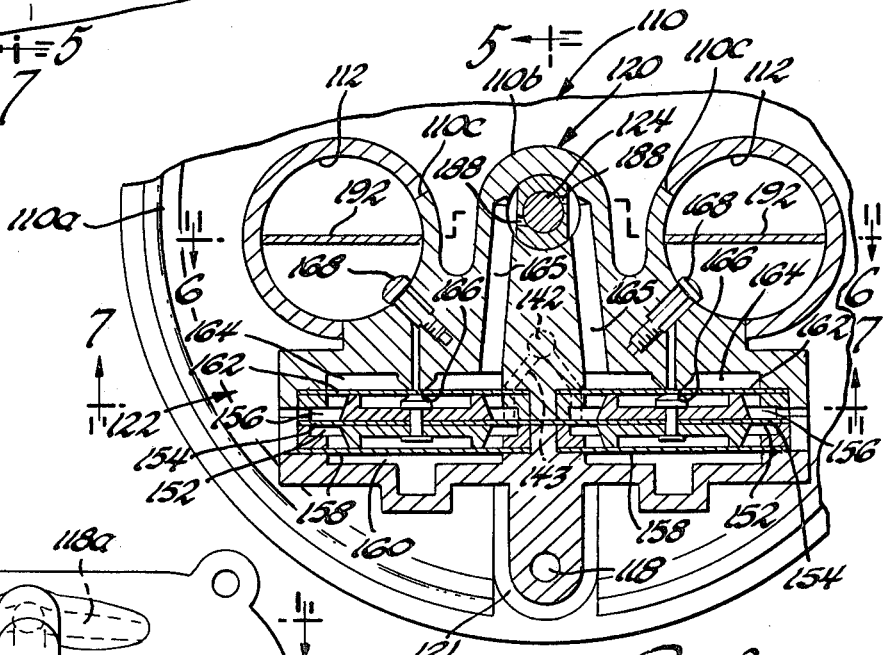
FIG. 8 is a horizontal sectional view of that carburetor, as indicated by the lines 8—8 of FIGS. 5, 6 and 7, showing details of its pressure regulator.
Figure 9:
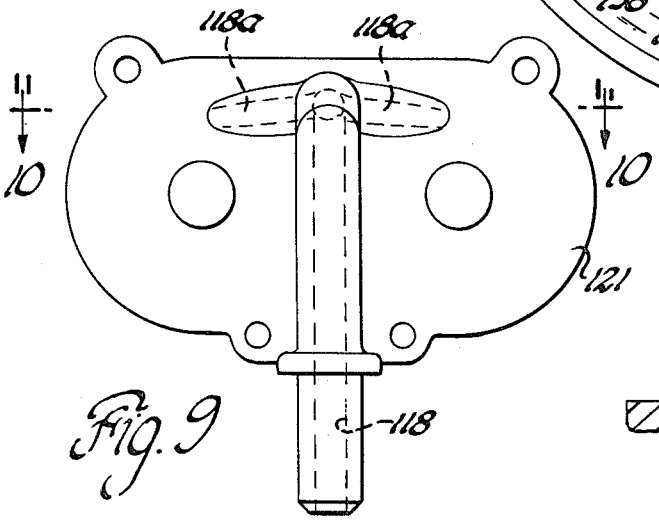
FIG. 9 is an end view of the pressure regulator cover, as indicated by the lines 9—9 of FIGS. 4 and 5, showing the fuel supply passage.
Figure 10:
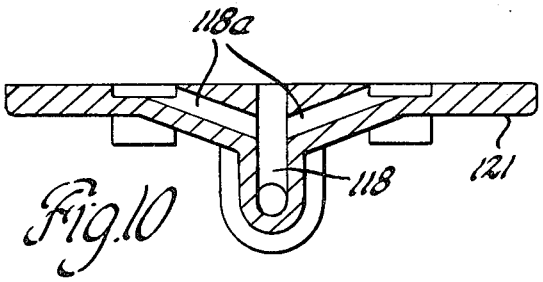
FIG. 10 is a horizontal sectional view through the pressure regulator cover, as indicated by the line 10—10 of FIG. 9, further showing the fuel supply passage.

As shown in FIG. 5, a pressure signal transducer 132 has a bypass portion 136 of induction passages 112 opening into the throttle bore portions 134 of induction passages 112 below throttles 130. Bypass portion 136 includes a pair of orifices 138 and 140 which define a signal region 142. A signal passage 143 extends from signal region 142 and branches as shown in FIGS. 7 and 8 to extend to signal chambers 152 within pressure regulator 122. Each signal chamber 152 is separated by a thin metal diaphragm 154 from a chamber 156 open to the atmospheric pressure of air inlet region 114. Each signal chamber 152 is also separated by a thin metal diaphragm 158 from a chamber 160 connected by branch passages 118*a* (FIGS. 9 and 10) to sense the supply pressure of fuel in passage 118. Each atmospheric chamber 156 is separated by a thin metal diaphragm 162 from a discharge pressure chamber 164 which receives fuel from fuel meter 120 through a passage 165. Diaphragms 162 control fuel flow from chambers 164 through valve seats 166 to the fuel nozzles 168 which open into induction passages 112, maintaining the pressure drop across fuel meter 120 substantially proportional to the vacuum signal in region 142.

As shown in FIG. 5, fuel supply passage 118 extends to a recess 170 about a hollow cylindrical sleeve 172. Apertures 174 open from recess 170 through sleeve 172 to a bore 176 about the neck 178 of metering rod 124. Neck 178 carries a guide portion 180 to align metering rod 124 within the bore 176 of sleeve 172.

Below neck 178, metering rod 124 has a pair of symmetrically disposed beveled end surfaces 182 which intersect the cylindrical outer surface 184 of metering rod 124 along curved lines 186. Lines 186 overlie a pair of symmetrically disposed helical slots 188, which open from bore 176 to passages 165, to define a pair of fuel metering orifices. Thus as throttle shaft 126 is rotated to open throttles 130, lever 125*a* pulls links 125*b* and 125*d* downwardly and thus pulls metering rod 124 downwardly so that intersection lines 186 tranverse slots 188 and increase the fuel metering area of slots 188; the fuel metering orifice area is thereby maintained substantially proportional to the effective air flow area of air induction passages 112. As the fuel metering orifice area of slots 188 increases and additional fuel flows through passages 165 to discharge pressure chambers 164, diaphragms 162 will move away from valve seats 166 to allow increased fuel flow to fuel nozzles 168, thus maintaining the difference in pressure between chambers 160 and 164 (or the pressure drop across fuel metering slots 188) proportional to the difference in pressure between chambers 152 and 156 and thus proportional to the vacuum signal of signal region 142.

Accordingly, with the fuel metering area of slots 188 proportional to the effective flow area of induction passages 112 and the pressure drop across slots 188 proportional to the vacuum signal of region 142, fuel flow to fuel nozzles 168 will be substantially proportional to air flow through induction passages 112.

Figure 6:
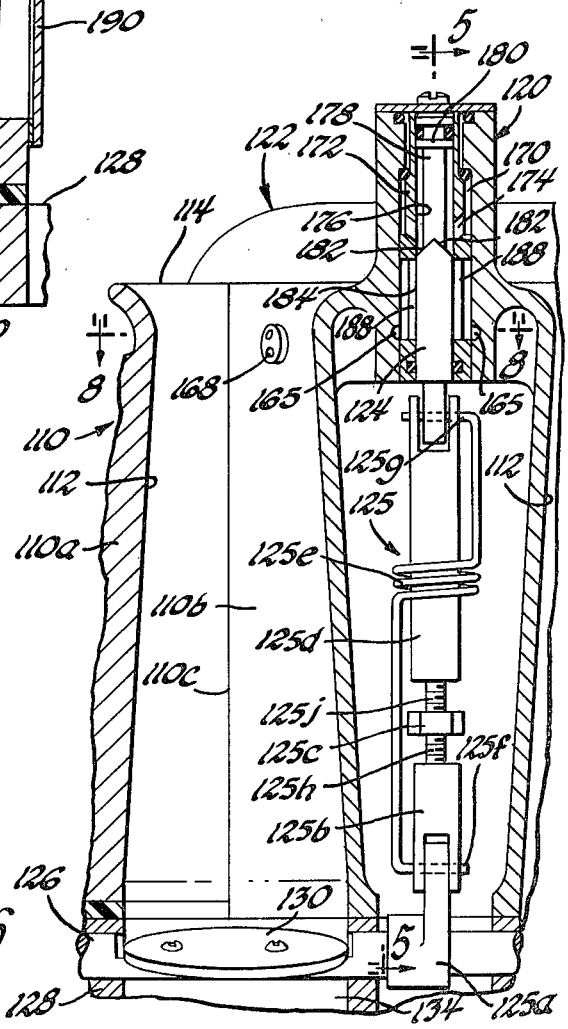
FIG. 6 is a transverse sectional view of that carburetor, as indicated by the lines 6—6 of FIGS. 4, 5 and 8, showing additional details of its fuel meter.

As shown in FIG. 5 and 6, a spring 125*e* holds linkage 125 in assembly and has end portions 125*f* and 125*g* which provide the pivotal connections between lever 125*a* and lower link 125*b* and between upper link 125*d* and metering rod 124. Adjusting screw 125*c* allows relative movement of links 125*b* and 125*d* to adjust the axial position of metering rod 124 in sleeve 172 relative to throttle shaft 126, the threads on portions 125*h* and 125*j* differing to allow very slight adjustment of metering rod 124. Adjusting screw 125*c* also allows relative movement of links 125*b* and 125*d* to adjust the rotational position of metering rod 124 in sleeve 172.

Figure 11:
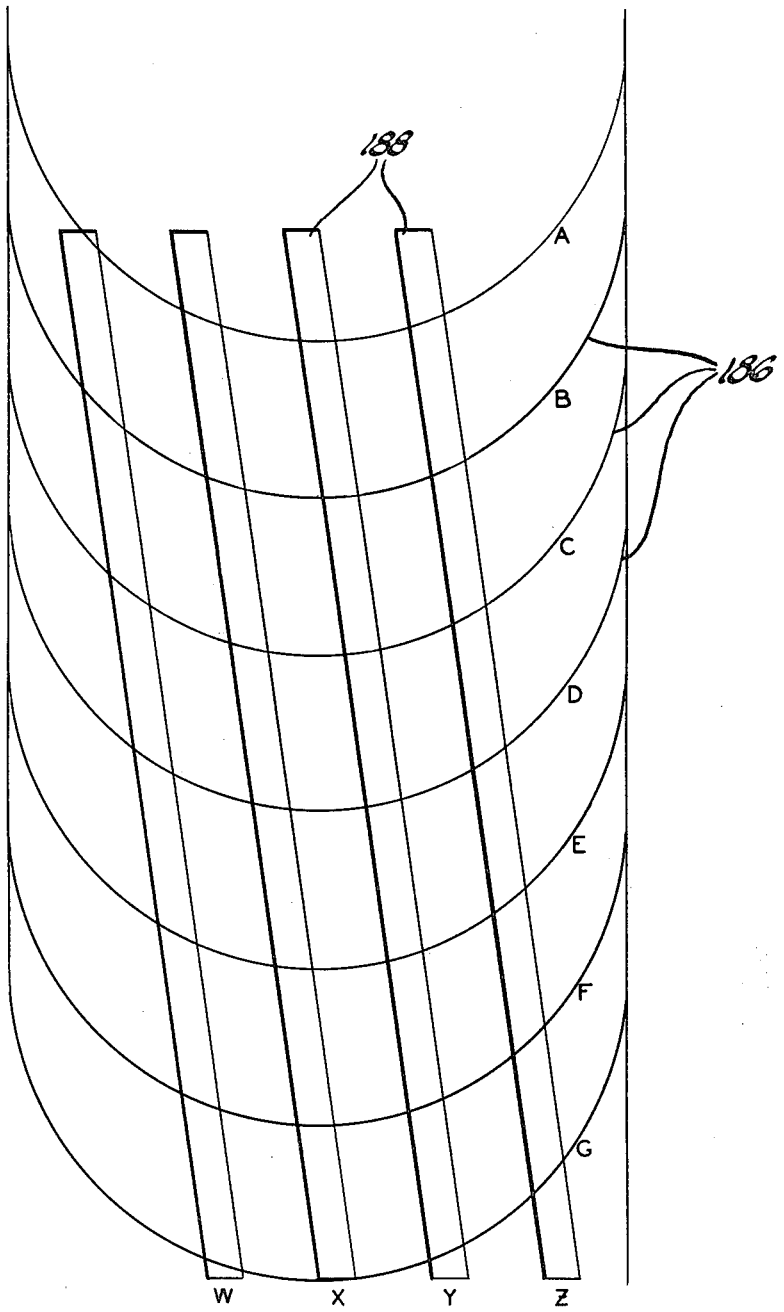
FIG. 11 graphically illustrates the variation in flow area of a helical metering slot achieved by axial and rotational adjustment of a beveled metering rod relative to the metering slot as in that carburetor.

FIG. 11 illustrates the effect of axial and rotational adjustment of metering rod 124 in sleeve 172. The letters A, B, C, D, E, F and G illustrate various axial positions of an intersection line 186—between a beveled end surface 182 and the cylindrical outer surface 184 on metering rod 124—relative to sleeve 172. The letters W, X, Y and Z indicate various rotational positions of an intersection line 186 relative to a slot 188. It can be appreciated that for any position A through G of metering rod 124, rotation of metering rod 124 from position W to position Z would vary the fuel metering area of the slot exposed above the intersection line 186. Accordingly, adjustment of the fuel metering orifice area exposed above metering rod 124 may be effected by rotational adjustment of metering rod 124 within sleeve 172 as well as axial adjustment of metering rod 124 within sleeve 172. This construction accordingly permits separate, although not independent, adjustments of the minimum and maximum fuel metering areas and thus the minimum and maximum fuel flow for closed throttle and wide open throttle operating conditions. Preferably, metering rod 124 is adjusted axially to establish the minimum fuel flow under closed throttle operating conditions and is adjusted rotationally to establish the maximum fuel flow under wide open throttle operating conditions; a plate 190 (FIG. 5) then seals access to adjusting screw 125*c*.

It will be appreciated that nozzles 168 could be located to discharge in other regions such as the intake manifold or the engine intake ports. When located in induction passage 112 as shown, baffles 192 (FIGS. 4 and 8) may be helpful in achieving proper distribution of the fuel.

The embodiments of the invention in which an exclusive property or privilege is claimed are defined as follows:

1. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, and the improvement comprising:

means in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the difference between the inlet pressure and the pressure signal for generating a physical parameter which varies continuously with and is indicative of that difference, means responsive to the position of said throttle for generating a physical parameter indicative of the effective area of said induction passage, and means for combining said parameters to establish an engine control parameter varying substantially in proportion to the rate of air flow through said induction passage.

2. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, and the improvement comprising:

means defining a converging nozzle in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the difference between the inlet pressure and the pressure signal for generating a physical parameter which varies continuously with and is indicative of that difference, means responsive to the position of said throttle for generating a physical parameter indicative of the effective area of said induction passage, and means for combining said parameters to establish an engine control parameter varying substantially in proportion to the rate of air flow through said induction passage.

3. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, and the improvement comprising:

means defining a series of orifices in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the difference between the inlet pressure and the pressure signal for generating a physical parameter which varies continuously with and is indicative of that difference, means responsive to the position of said throttle for generating a physical parameter indicative of the effective area of said induction passage, and means for combining said parameters to establish an engine control parameter varying substantially in proportion to the rate of air flow through said induction passage.

4. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, and the improvement comprising:

means defining a capillary tube orifice and another orifice in series in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the difference between the inlet pressure and the pressure signal for generating a physical parameter which varies continuously with and is indicative of that difference, means responsive to the position of said throttle for generating a physical parameter indicative of the effective area of said induction passage, and means for combining said parameters to establish an engine control parameter varying substantially in proportion tothe rate of air flow through said induction passage.

5. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, and the improvement comprising:

means defining a venturi and another orifice in series in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the difference between the inlet pressure and the pressure signal for generating a physical parameter which varies continuously with and is indicative of that difference, means responsive to the position of said throttle for generating a physical parameter indicative of the effective area of said induction passage, and means for combining said parameters to establish an engine control parameter varying substantially in proportion to the rate of air flow through said induction passage.

6. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, a fuel passage, and the improvement comprising:

means in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the difference between the inlet pressure and the pressure signal for generating a physical parameter which varies continuously with and is indicative of that difference, means responsive to the position of said throttle for generating a physical parameter indicative of the effective area of said induction passage, and means for controlling fuel flow through said fuel passage in accordance with said parameters to establish a rate of fuel flow through said fuel passage varying substantially in proportion to the rate of air flow through said induction passage.

7. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle and for an established pressure in said inlet varies substantially uniformly with the pressure in said manifold when the manifold pressure is greater than about one-half the inlet pressure, and wherein the air flow rate does not vary substantially with the manifold pressure when the manifold pressure is less than about one-half the inlet pressure, a metering orifice, and the improvement comprising:

means in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the pressure signal for maintaining the pressure difference across said metering orifice substantially proportional to the difference between the inlet pressure and the pressure signal, means responsive to the position of said throttle for maintaining the area of said metering orifice substantially proportional to the effective area of said induction passage, and means for directing fuel through said orifice to establish fuel flow at a rate substantially proportional to the rate of air flow through said induction passage.

8. In an engine, the combination of:

an induction passage, including parallel throttle bore and bypass portions each opening from an air inlet to a manifold and a throttle in said throttle bore portion between said inlet and said manifold for varying the effective area of said induction passage, wherein the rate of air flow for any selected position of said throttle varies substantially in proportion to the square root of the difference between the pressure in said inlet and the pressure in said manifold when the manifold pressure is greater than about one-half the inlet pressure, and wherein the air flow rate does not vary in proportion to the square root of said difference when the manifold pressure is less than about one-half the inlet pressure, a metering orifice, and the improvement comprising:

means in said bypass portion for creating a pressure signal which differs from the inlet pressure by an amount substantially proportional to the square of the air flow rate both when the manifold pressure is less than about one-half the inlet pressure and when the manifold pressure is greater than about one-half the inlet pressure, means responsive to the pressure signal for maintaining the pressure difference across said metering orifice substantially proportional to said amount, means responsive to the position of said throttle for maintaining the area of said metering orifice substantially proportional to the effective area of said induction passage, and means for directing fuel through said orifice to establish fuel flow at a rate substantially proportional to the rate of air flow through said induction passage.

9. The method of controlling fuel flow in an engine having an air induction passage including parallel throttle bore and bypass portions each opening from an air inlet to a manifold and a throttle in said throttle bore portion between said inlet and said manifold for varying the effective area of said air induction passage, said method comprising the steps of:

measuring the rate of air flow through said air induction passage by:

creating a pressure signal in said bypass portion which differs from the inlet pressure by an amount substantially proportional to the square of the air flow rate for any selected position of said throttle and for an established pressure in said inlet both when the pressure in said manifold is less than about one-half the inlet pressure and when the manifold pressure is greater than about one-half the inlet pressure, generating a physical parameter which varies continuously with and is indicative of the difference between the inlet pressure and the pressure signal, and generating a physical parameter which varies with the position of said throttle and is a measure of the effective flow area of said air induction passage, and controlling the rate of fuel flow in accordance with said parameters to provide a rate of fuel flow substantially proportional to the rate of air flow through said induction passage.

* * * * *